US005574954A

United States Patent [19]

Panchal

[11] Patent Number: 5,574,954

[45] **Date of Patent: * Nov. 12, 1996**

[54] EROSION-RESISTANT TITANIUM CARBIDE COMPOSITES AND PROCESSES FOR MAKING THEM

[75] Inventor: Jayanti M. Panchal, Spring Valley, N.Y.

[73] Assignee: Alloy Technology International, Inc., West Nyack, N.Y.

[ * ] Notice: The portion of the term of this patent subsequent to May 18, 2014, has been disclaimed.

[21] Appl. No.: 893,425

[22] Filed: Jun. 4, 1992

[51] Int. Cl.[6] ..... B22F 3/00

[52] U.S. Cl. ..... 419/14; 419/29; 419/32; 419/38; 419/44; 419/49; 419/53; 419/60

[58] Field of Search ..... 75/236, 242, 245, 75/246, 252; 419/6, 14, 32, 33, 38, 44, 49, 53, 29, 60

[56] References Cited

U.S. PATENT DOCUMENTS

| | | | |
|---|---|---|---|
| 3,653,982 | 4/1972 | Prill | 75/236 |
| 3,715,792 | 2/1973 | Prill et al. | 75/236 |
| 3,779,720 | 12/1973 | Ellis et al. | 428/564 |
| 3,977,837 | 8/1976 | Mal et al. | 75/236 |
| 4,019,874 | 4/1977 | Moskowitz | 75/241 |
| 4,108,649 | 8/1978 | Moskowitz | 419/16 |
| 4,173,471 | 11/1979 | Mal et al. | 75/237 |
| 4,456,484 | 6/1984 | Benjamin et al. | 75/252 |
| 4,704,336 | 11/1987 | Spriggs | 428/552 |
| 4,770,703 | 9/1988 | Tarutani et al. | 75/246 |

*Primary Examiner*—Ngoclan Mai
*Attorney, Agent, or Firm*—Donald D. Mon

[57] ABSTRACT

A composite, a sintered product of the composite, and a process for producing products from this composite. The composite has a very high volummetric proportion of TiC, and its remainder of a matrix. The TiC constitutes at least 70% by volume and as much as 95% by volume of the ultimate product. The process includes making a green body which can be handled and is thereafter pre-sintered to form a pre-form. The pre-form is oversized relative to the ultimate product. It is sintered and machined, again oversize. Then it is again sintered and subjected to hot isostatic compression, to assume at least a close approximation to the pre-determined dimension of the product. It is characterized by its light weight, resistance to erosion, and resistance to chemical attack.

8 Claims, No Drawings

EROSION-RESISTANT TITANIUM CARBIDE COMPOSITES AND PROCESSES FOR MAKING THEM

FIELD OF THE INVENTION

This invention relates to erosion-resistant titanium carbide composites, and to processes for making them.

BACKGROUND OF THE INVENTION

Titanium carbide (TIC) composites, and tungsten carbide (WC) composites are well recognized for their resistance to wear, and general corrosion and resistance to softening at high temperature. Products of of widely varying nature and utility are made from them, and in many applications they serve very well. In many or most cases, the TiC composites function as well as WC composites and frequently cost and weigh less.

However, there are some applications which until this invention have have been better served by WC composites than by TiC composites. For example, previously-known TiC composites are not sufficiently resistant to erosion to be useful in applications such as valves, seals, and bearing surfaces, feed screws, concrete spraying and sandblasting nozzles which will be exposed to severely erosive fluids, particles, and fluid streams. Examples are encountered in, mining, geothermal drilling, and coal liquefication industries.

This field of applications has been primarily served by WC composites in which WC particles are sintered into a cobalt matrix. Even as to these, wherever hydrogen sulfide is likely to be encountered, such as in most deep hole drilling, the cobalt matrix is subject to severe chemical erosion, although that was accepted as an unavoidable circumstance, because there was no alternative.

Over the years conditions have changed. The supply of cobalt has become increasingly unreliable, and as a consequence increasingly expensive. This is because it mostly comes from the country of Zaire, whose social conditions are not conducive to reliability of mining and export operations. This combined with the high specific gravity and inferior erosion resistance (to some conditions) of WC—Co composites, has led the instant inventor to invent a new composite of lesser weight and cost, and with improved erosion resistance.

Lightness of weight becomes important when the composite is incorporated in a moving part. The lighter the composite is, the less energy is needed to move it in operation. The more resistant the composite is to erosion, the longer its life, and the longer the period will be between repair and replacement.

This invention provides a lighter weight composite with erosion resistance at least equivalent to cobalt/WC composites, it utilizes constituents which are readily available in the United States at normal prices. It also can utilize various matrices with high concentrations of TiC capable of being resistant to many chemical erosive conditions which may be damaging to WC/cobalt such as $H_2S$.

BRIEF DESCRIPTION OF THE INVENTION

A composite according to this invention comprises titanium carbide grains sintered in a matrix. The matrix is a high chrome tool steel, or a nickel/molybdenum alloy, or cobalt. The TiC provided constitutes between at least 70% and about 95% by volume of the composite, the remainder being the matrix. The preferred range is between 80 and 95 percent by volume.

This is a sintered product. The TiC and the matrix are provided as powder Granules, and are mixed and formed as a rigid body as a consequence of applied heat and pressure. According to the preferred process of this invention, the mixture of the components will be presintered to form a rigid body, and in the presintered condition is machined oversize. The resulting presintered and machined body is then sintered at an appropriate temperature and pressure to its final shape and condition.

This invention will be fully understood from the following detailed description.

DETAILED DESCRIPTION OF THE INVENTION

This invention is a sintered product (and a powder prepared for sintering) which is predominantly TiC sintered in a matrix. In this invention, the content of TiC will variously be given as volume percent, or by weight percent. The specific gravity of TiC is lower compared to the specific gravity of the matrix material, so that the volumetric percentage generally is much higher than its weight percentage.

This is an important observation as it applies to composites which are to resist erosion by fine particles. Solid particles are the principal source of damage to composites, because of their collision with the matrix. Both TiC and WC can withstand this erosion, however it is the matrix which is at risk. The risk can be minimized by reducing the exposed matrix to the erosive particles. One way to accomplish this is to increase the volume percentage of the carbide.

Composites comprising titanium carbide (TIC) embedded in various matrices are well known. Mal U.S. Pat. No. 3,977,837, issued Aug. 31, 1976, shows TiC composites which are valued for their resistance to wear, to thermal shock, and to impact. Also they can provide improved anti-friction properties. The Mal patent also shows various processes for making these composites, generally by sintering. The Mal patent is incorporated herein in its entirety by reference for its showing of such composites and processes for making them.

WC—Co composites are known which have as high as 94% WC by volume, with the remainder cobalt. These function well enough in many erosive environments except where hydrogen sulfide is present. In addition, on a volume basis of product, more WC (by weight) is needed than would be required if TiC could be used. If instead of a cobalt matrix a nickel/chromium matrix were to be substituted for the WC composites, a lesser volume percentage of WC might be used, and the erosion resistance would be significantly reduced. This invention can use not only cobalt for a matrix, but also other matrices in which WC can not be sintered in amounts sufficient for the intended usage.

Composites of TiC with various matrices are well known and have been used by Alloy Technology International, Inc., of 169 Western Highway, West Nyack, N.Y. 10994, under its trademark Ferro-TiC. The highest volumetric percentage of TiC of which the instant inventor is aware is less than 70% in such composites. They are not intended for severely erosive applications. Despite the fact that TiC is much harder and much lighter than WC, the market acceptance of WC—Co composites, and the considerable doubt that a suitably high volume percentage of TiC could be gotten into a matrix for erosion resistance, dissuaded from any thought of using TiC in such applications. The suitability of the composite of this invention has taken its inventor by considerable surprise.

Table I shows the chemical composition of six TiC composites, of which three exemplify the invention (C, D and E), and three are other composites for comparison (A, B and F). This table includes one example of WC in a cobalt matrix, for comparison (G):

TABLE I

| | | Chemistry, Wt % | | | | | | | |
|---|---|---|---|---|---|---|---|---|---|
| | | Hard Phase | | Matrix | | | | | |
| I.D. | Matrix Alloy Type | TiC | WC | C | Cr | Mo | Ni | Co | Fe |
| A | High Chrome Tool Steel | 60.10 | — | .85 | 10.00 | 3.00 | — | — | Bal. |
| B* | High Chrome Tool Steel | 60.10 | — | .85 | 10.00 | 3.00 | — | — | Bal. |
| C | High Chrome Tool Steel | 85.20 | — | .85 | 10.00 | 3.00 | — | — | Bal. |
| D | Nickel-Molybdenum | 83.00 | — | — | — | 10.00 | Bal. | — | — |
| E | Cobalt | 83.20 | — | — | — | — | — | 100 | — |
| F | High Chrome Tool Steel | 34.50 | — | .85 | 10.00 | 3.00 | — | — | Bal. |
| G | Cobalt | — | 90 | — | — | — | — | 100 | — |

Table II shows certain of the physical characteristics of these composites, and it describes their erosion mechanisms.

TABLE II

| I.D. | Density g/cc | Hardness HRC | Erosion Rate cc/g × 10 −6 | Erosion Mechanism |
|---|---|---|---|---|
| A | 5.77 | 74.2 | 2.08 | Matrix Extrusion, Carbide Fragmentation, and Ductile Cutting |
| B | 5.79 | 72.2 | 2.42 | |
| C | 5.21 | 77.7 | 0.96 | Matrix Extrusion, Carbide Fragmentation |
| D | 5.38 | 76.5 | 1.47 | |
| E | 5.35 | 75.8 | 1.17 | |
| F | 6.46 | 69.6 | 3.10 | Matrix Extrusion, Ductile Cutting, and Carbide Fragmentation |
| G | 14.60 | 75.0 | 1.46 | Preferential Binder Erosion, Carbide Fracture |

Table III shows the comparative erosion rates of the various composites.

TABLE III

| Alloy | Erosion Rate (cc/g × $10^{-6}$) |
|---|---|
| A | 2.08 |
| B | 2.42 |
| C | 0.96 |
| D | 1.47 |
| E | 1.17 |
| F | 3.10 |
| G | 1.46. |

It will be observed that the erosion rates of examples A, B, and F (TiC in tool steel), greatly exceed the rates of examples C, D, and E, all of which have a much higher TiC volume percentage. By way of comparison, example G (Cobalt and WC) equals the performance of example D, but is much less resistant than examples C and E. Here it may be commented that the density of examples C, D and E are 5.21, 5.38 and 5.35g/cm$^3$, respectively. The density of example G is 14.6 g/cm$^3$. Considered on a volumetric basis, to create a body, the example G will require nearly three times as much material by weight (principally because of the greater density of WC compared to TiC.) The weight of the body is nearly tripled, and so is the cost, unless the product is sold at less than its correct value. In table I, the percentage of TiC is given by weight. It can instead as conveniently be referred to by volume percentage. A hard phase TiC on the order of 83–85% by weight will be on the order of 90% by volume. In examples A and B, the weight percentage of about 60% is above 70% by volume.

Composites according to this invention will have at least 70% by volume of TiC. A volume percentage between about 80%–95% is preferred. The remainder is the matrix material.

The high chrome steel matrix will have between about 8% to about 20% chromium, 3 to 10% molybdenum, 0.3 to 1.2% carbon, the balance being iron.

The nickel molybdenum matrix will have about 5% to about 20% molybdenum, the balance being nickel.

To prepare the composites, the defined weights of the various elements and of the TiC are supplied in powder form to a ball mill which is run fop a sufficient time to insure homogenization and proper particle size. The milling fluid is removed, and the homogeneous mixture of powder is dried under vacuum to prevent oxidation. A small amount of wax, perhaps 2% can be added as a binder but this evaporates during the final sintering and is not considered as part of the formulation.

The powder is screened prior to pressing. The resulting powder will then be pressed to an oversized shape, and to achieve a green state sufficient to handle.

There follows a pre-sintering at approximately 1,000 degrees C. for about 2 hours in a vacuum of about 150 to 200 microns of mercury.

Importantly, even with its very high carbide percentage, this pre-sintered body can be machined. It will be machined oversized, because after the final sintering and subsequent hot isostatic pressing 15% to 20% shrinkage will occur. Experience with the manufacturing parameters and with the proportions of constituents will give the processor ample guidance for repeated manufacture of near net shape parts.

The presintered composites are then sintered at about 1,450 degrees C. for about two hours in a vacuum of between about 150 and 200 microns of mercury. Then the composite is hot isostatically pressed at about 1,350 degrees C. for about 4 hours in an argon atmosphere, at an applied steady pressure of about 15 ksi.

Composites A, B, C and F will thereafter be isothermically annealed at about 800 degrees C. for about 4 hours. All composites were machined to near net shape.

Composite A, B, C and F (Tool Steel Matrix) will be heat treated under protective conditions at about 1,080 degrees C. for 1 hour per inch of thickness, followed by quenching in air and double tempering at about 525 degrees C. for one hour (twice). This treatment will give martensitic properties to the tool steel matrix. Composites D and E will be stress-relieved at about 900 degrees C. for about 4 hours, and cooled. The heat treatment discoloration will be removed by grinding and polishing.

It has been observed that polishing the surface of the composite article improves its erosion resistance. Polishing with successively finer grit silicon carbide papers, followed by diamond-paste and alumina powder using known techniques, appears to be beneficial.

The above manufacturing techniques can be varied when the percentage of TiC or matrix composition is changed, but do produce a useful product as described.

Scanning electron microscope studies have shown that densities of at least 99% of the theoretical density are obtained.

This invention thereby provides TiC composites having a surprisingly high percentage of TiC, a percentage not therefore believed to be known, certainly not for a composite to be exposed to severe erosion. In the course of its processing, machining to close tolerences can be attained, on compositions which, if machining was thought of at all, would not have been thought to be attainable.

This invention is not to be limited to the embodiments described in the description, but only on accordance with the scope of the appended claims.

I claim:

1. The process of preparing a sintered body of defined dimensions from a composite of matrix powder and TiC powder, said composite comprising at least about 70% of TiC powder by volume, comprising the following steps in the order recited:

a. milling said matrix powder and TiC powder together to form said composite to be sintered;

b. pressing said composite to a pre-form with a shape oversized with respect to said defined dimensions, and to a green state sufficiently integral to be handled;

c. applying heat to said pre-form for a period of time and at a sufficient temperature to pre-sinter the pre-form, and cooling the pre-form;

d. machining the pre-form to a shape oversized with respect to said defined dimensions by amounts to provide for shrinkage of the machined pre-form in subsequent processing;

e. applying heat to said machined pre-form to sinter the same;

f. hot isostatically pressing the product from step e to reduce its shape approximately to said defined dimensions;

g. isostatically annealing the product from step f; and h. cooling the product from step g.

2. A process according to claim 1 in which the TiC is between about 70% and about 95% by volume of the composite.

3. A process according to claim 1 in which the TiC is between about 80% and about 95% by volume of the composite.

4. A process according to claim 1 in which steps c,e, and f are conducted in a vacuum.

5. A process according to claim 4 in which step f is conducted in an inert atmosphere.

6. A process according to claim 5 in which said inert atmosphere is argon gas.

7. A process according to claim 4 in which the TiC is between about 70% and about 95% by volume of the composite.

8. A process according to claim 4 in which the TiC is between about 80% and about 95% by volume of the composite.

* * * * *